United States Patent [19]

Janssens

[11] 4,423,142

[45] Dec. 27, 1983

[54] PHOTOGRAPHIC SILVER HALIDE COLOR MATERIALS AND PROCESS FOR THE PRODUCTION OF DYE IMAGES BY DIFFUSION TRANSFER

[75] Inventor: Wilhelmus Janssens, Aarschot, Belgium

[73] Assignee: AGFA-Gevaert, N.V., Mortsel, Belgium

[21] Appl. No.: 350,033

[22] Filed: Feb. 18, 1982

[30] Foreign Application Priority Data

Mar. 2, 1981 [GB] United Kingdom ..... 8106515

[51] Int. Cl.[3] ..... G03C 5/54; G03C 1/40; G03C 1/10

[52] U.S. Cl. ..... 430/504; 430/212; 430/214; 430/217; 430/223; 430/505; 430/506

[58] Field of Search ..... 430/212, 214, 217, 223, 430/505, 506, 504

[56] References Cited

U.S. PATENT DOCUMENTS 4,139,379 2/1979 Chasman et al. ..... 430/223
4,232,107 11/1980 Janssens ..... 430/223
4,353,975 10/1982 Janssens et al. ..... 430/223

*Primary Examiner*—Richard L. Schilling
*Attorney, Agent, or Firm*—A. W. Breiner

[57] ABSTRACT

Photographic material and process suitable for producing by diffusion transfer a color image and comprising on a support at least two differently spectrally sensitive negative working silver halide emulsion layers (FIG. 3, layers 12, 14 and 16) and having operatively associated with each of said emulsion layers a different non-diffusing dye providing compound that is initially immobile in an alkali-permeable colloid medium and wherefrom by reduction in alkaline medium a dye or dye precursor can be split off in diffusible state, wherein at least one of said negative working silver halide emulsion layers is associated in water-permeable relationship with a visible light-sensitive direct-positive emulsion layer (FIG. 3, layers 13 and 15) whereby interimage effects can be obtained.

10 Claims, 3 Drawing Figures

PHOTOGRAPHIC SILVER HALIDE COLOR MATERIALS AND PROCESS FOR THE PRODUCTION OF DYE IMAGES BY DIFFUSION TRANSFER

The present invention relates to photographic silver halide colour materials and process for the production of positive dye images by diffusion transfer. More particularly the present invention relates to photographic silver halide colour materials and process for the production of dye images by diffusion transfer in which a positive working silver halide emulsion layer co-operates with a negative working silver halide emulsion layer to produce favourable interimage effects e.g. resulting in an improved colour saturation of a multicolour print.

The production of a dye image by image-wise modulated diffusion transfer of a dye with a photographic silver halide emulsion material can be carried out in a number of ways. The dye diffusion transfer systems operating with photosensitive silver halide are all based on the same principle, viz. the alteration in the mobility of a dye or of a molecule part being a dye is controlled by the image-wise development of silver halide to silver.

For that purpose ballasted dye-providing chemicals have been developed one type of which is negative working in that they yield negative colour transfer images in combination with negative working silver halide emulsions and the other type is positive (also called reversal) working in that they yield positive colour transfer images in combination with negative working silver halide emulsions. Of two systems for positive working as hereinafter described, the present invention relates to the second system as hereinafter set forth.

According to a first colour imaging system for producing positive colour images by diffusion transfer, with negative working silver emulsions hydroquinone-dye developers are used which include the hydroquinone structure and have permanently attached thereto a coloured substituent i.e. either a yellow, magenta or cyan coloured substituent for subtractive multicolour image formation.

In the development of the exposed silver halide the hydroquinone-dye developer is oxidized and thereby transformed into a non-ionizable immobile quinone. Unoxidized hydroquinone-dye is transferred by diffusion to a receptor element. Examples of these dye developers and more details about said system are described in U.S. Pat. Nos. 2,983,606 of Howard G. Rogers, issued May 9, 1961 and 3,362,819 of Edwin H. Land, issued Jan. 9, 1968.

According to a second colour diffusion transfer system a positive dye image is produced by a diffusible dye which is set free image-wise from a negative working emulsion material by reaction of a particular initially immobile image-dye providing compound with image-wise remaining non-oxidized developing agent. Examples of such system providing in a receptor element positive diffusion transfer dye images with the aid of an image-wise exposed and developed negative working silver halide emulsion material are described, e.g., in the U.S. Pat. Nos. 4,139,379 of Richard A. Chasman, Richard P. Dunlap and Gerald C. Hinshaw and 4,139,389 of Jerald C. Hinshaw and Richard P. Henzel, both issued Feb. 13, 1979, in the published European Patent Applications 0 004 399 filed Mar. 9, 1979 and 00 38 092 filed Mar. 18, 1981 both by Agfa-Gevaert N.V.

An interesting more detailed survey of colour diffusion transfer systems, although not complete is presented under the heading "Image-transfer processes" by L. J. Fleckenstein in the book "The Theory of the Photographic Process", 4th ed.—Macmillan Publishing Co., Inc. New York (1077) p. 366–372.

In the production of colour prints in the classical silver halide photography, using colour couplers forming dyes upon coupling with oxidized developing agent, interlayer effects also called interimage effects are used to obtain masking of side absorptions and to influence the development of components in adjacent layers to some extent. So, the amount of dye formed in an area of a layer depends also on the degree of exposure of the other layers in that area [ref. T. H. James, The Theory of the Photographic Process, 4th ed.—Macmillan Publishing Co., Inc. New York (1977) p. 533].

In subtractive colour photography a white area of the original will be represented by the absence of any dye, whereas a black or grey area will be represented by the superposition of yellow, magenta and cyan dye. Beer's law is valid for the dyes of that system. This law states that the optical density at any wavelength is proportional to the concentration of the dye, which means in dye diffusion transfer proportional to the amount of dye superposed in the receptor element. In other words, the analytical spectral density of the composite colour image is equal to the sum of the spectral densities of the component light-absorbers i.e. the individual dyes at any wavelength.

BRIEF DESCRIPTION OF THE DRAWINGS

Spectral density distribution graphs i.e. spectral density D versus wavelength in nm of cyan (C), magenta (M) and yellow (Y) dyes for a hypothetical colour film and of the composite absorption (N) at any wavelength of the visible spectrum are given in FIG. 1.

Figure 1:
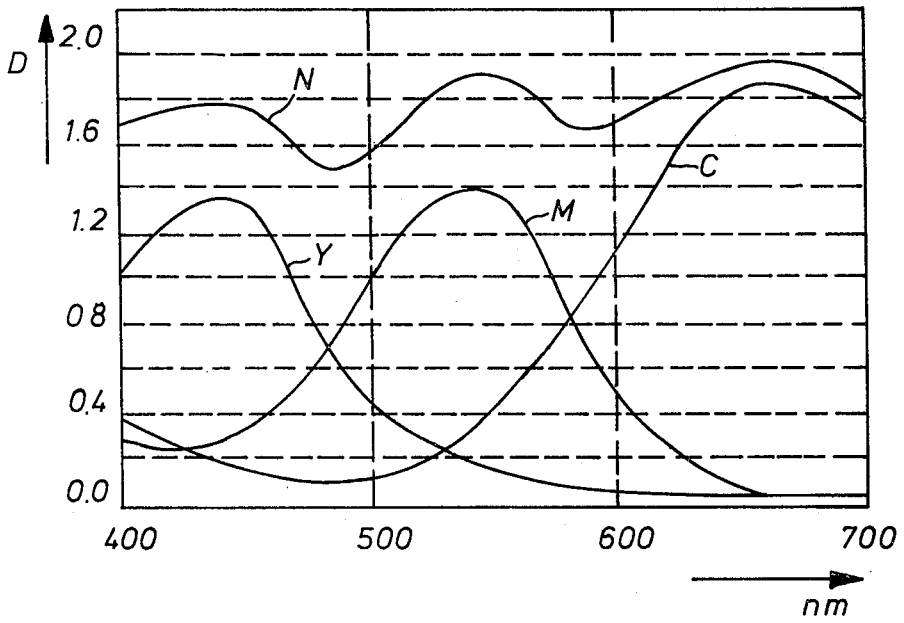

From FIG. 1 it can be learned that by the side absorptions of the dyes the composite light absorption represented by curve N is at every wavelength higher than the light absorption of the individual dyes (C), (M) and (Y) at that wavelength.

Since the spectral densities of the individual dyes over the whole visible spectrum are additive, the spectral integral density $D_N$ of a neutral grey image area can be written as the sum of the component spectral densities $$D_N = D_C + D_M + D_Y$$

i.e. the sum of the cyan density, magenta density and yellow density.

When interimage effects play a role and in the production of a neutral grey image area more of each individual dye is formed or deposited than in an image area of a one third spectrum (primary) colour which is red, green or yellow (in the subtractive system red is built up by superposition of yellow and magenta dye, green by superposition of cyan and yellow dye and blue by superposition of magenta and cyan dye) the appearance of the final multicolour image will lack brightness i.e. a colour image of poor colour saturation will be obtained. Such result is due to a so-called negative interimage effect.

If on the contrary due to interimage effects one of the individual dyes will be formed or deposited in a one third spectrum colour area in an amount larger than in a neutral grey area a colour image of increased colour saturation and more bright appearance will be obtained. This result is due to a so-called positive interimage effect.

Considering the above mentioned first imaging system we may conclude that due to the inherent properties of said system a negative interimage effect is produced because individual dye deposition in correspondence with one third spectrum colour areas will be smaller than individual dye deposition in a neutral grey area. Such is explained with the aid of FIG. 2 for the deposition of cyan dye used in building, as a one third spectrum colour area, a green area and a neutral grey area respectively.

Figure 2:
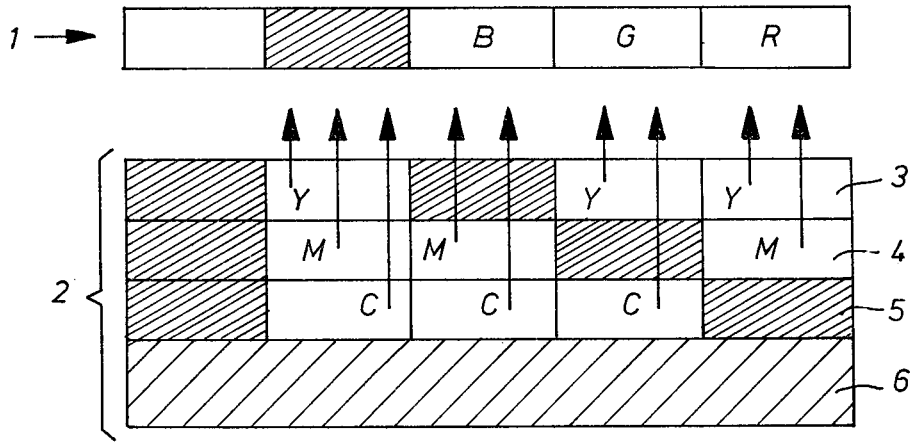
FIG. 2 represents the structure and working mechanism of a dye diffusion transfer material for operating as explained in the first mentioned colour imaging system.

Said FIG. 2 relates to a simplified representation of a photographic material operating according to said first imaging system. A more detailed structure of such material is given in the already mentioned book The Theory of the Photographic Process 4th ed. (1977) p. 367.

In the present FIG. 2 element 1 represents a multicolour original in which the letters B, G and R represent blue, green and red image areas, the black image area is hatched and the colourless image area is left blank. Element 2 represents a multicolour photographic element having three differently spectrally sensitive negative working silver halide emulsion layers viz. a blue-sensitive layer 3, a green-sensitive layer 4 and a red-sensitive layer 5 and a support 6. The blue-, green-, and red-sensitive layers contain respectively a yellow (Y), magenta (M) and cyan (C) dye-developer. Where the photographic material 2 is not struck by light, i.e. in the area corresponding with the black image area of the original 1, in the development no dye-developer is oxidized in any of the silver halide emulsion layers 3, 4 and 5 corresponding with said black area and these dye-developers diffuse in an equal degree to a receptor material (not shown in the drawing). In the only green-light exposed area magenta dye is not released since in the green-sensitive layer 4 magenta dye-developer is oxidized by exposed silver halide and in oxidized form cannot diffuse any longer. In the non-exposed area of the blue- and red-sensitive layers 3 and 5 corresponding with the green image area of the original 1 non-oxidized yellow and cyan dye-developer diffuse. On diffusing through the green-sensitive layer 4 the cyan dye-developer encounters developable silver halide and a part of the cyan dye-developer becomes oxidized and immobilized therein, hereby leaving an equivalent amount of magenta dye-developer still in diffusible state. Hereby the green in the receptor material obtains a lower density and becomes greyish whereby the colour image brilliance is reduced. So, due to unwanted interimage effects between the different superposed dye yielding layers a negative influence on colour brilliance is obtained. With regard to FIG. 1 such means that one third spectrum colours are built up by a smaller amount of individual dyes than is present in a neutral grey area. As a consequence thereof, the neutral line N of a thus reproduced grey area lies higher than a neutral line N that would be obtained by addition of densities of each less effectively reproduced one third spectrum colour area.

The inherent properties of the second colour imaging system referred to hereinbefore offer colour prints wherein the amount of released dye in correspondence with a grey area and a one third spectrum primary colour area respectively are proportionally the same since in that system released dyes do not chemically interact in neighbouring layers. The interimage effect is thereby actually zero.

SUMMARY OF THE INVENTION

It is one of the objects of the present invention to modify a photographic material for use in the second colour imaging system in such a way that therewith a positive interimage effect can be obtained in order to improve the colour brilliance of the final print. According to another object the modification is used to obtain masking effects and to influence the hue of the individual colour areas of the print.

Therefor according to the present invention a photographic material is provided suitable for producing by diffusion transfer a positive colour image in a diffusion transfer receptor layer, which material comprises on a support at least two differently spectrally sensitive negative working silver halide emulsion layers and having operatively associated with each of said emulsion layers a different dye providing compound that is non-diffusing i.e. initially immobile in an alkali-permeable colloid medium and from which by reduction in an alkaline medium a dye or dye precursor can be split off in diffusible state, characterized in that at least one of said negative working silver halide emulsion layers is associated in water-permeable relationship with a visible light-sensitive direct-positive working silver halide emulsion layer.

DETAILED DESCRIPTION OF THE INVENTION

According to one embodiment the photographic material according to the present invention is one for producing a multicolour image by diffusion transfer and comprises a support carrying:

(I) a negative working red-sensitive silver halide emulsion layer having operatively associated therewith a dye-providing compound that is initially immobile in an alkali-permeable colloid medium and wherefrom by reduction in alkaline medium a cyan dye or cyan dye percursor can be split off in diffusible state, (II) a green-sensitive negative working silver halide emulsion layer having operatively associated therewith a said dye providing compound with the difference that a magenta dye or magenta dye precursor can be split off in diffusible state, and (III) a blue-sensitive negative working silver halide emulsion layer having operatively associated therewith a said dye providing compound with the difference that a yellow dye or yellow dye precursor can be split off in diffusible state, characterized in that between the blue-sensitive silver halide emulsion layer and the green-sensitive silver halide emulsion layer and between the green-sensitive silver halide emulsion layer and the red-sensitive silver halide emulsion layer in water-permeable relationship with said emulsion layers there is provided a visible light-sensitive direct-positive working silver halide emulsion layer. These direct-positive emulsions are preferably panchromatically sensitive, i.e. sensitive to visible light of the whole visible light (400–700 nm) spectrum.

Figure 3:
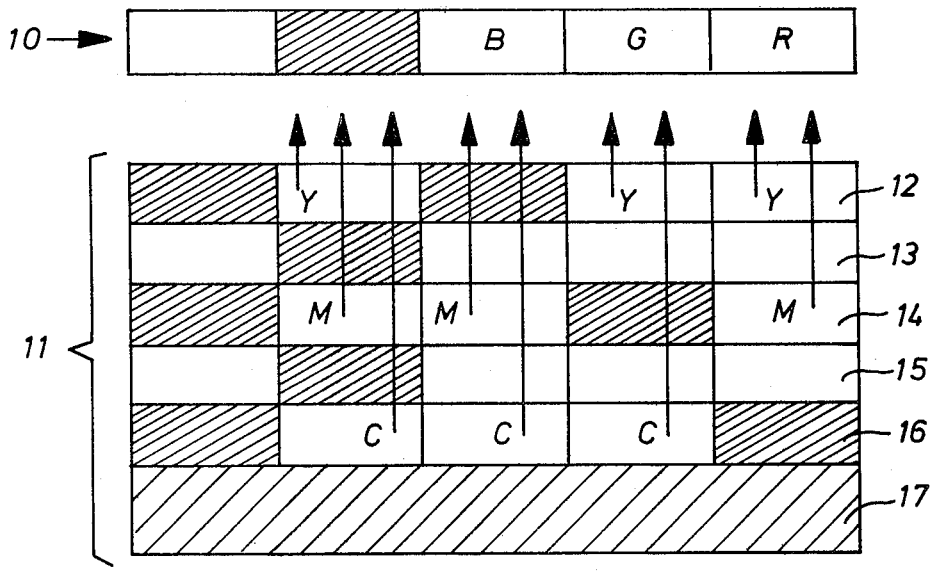
FIG. 3 represents the structure and working mechanism of a dye diffusion transfer material for operating according to the present invention.

The positive interimage effect obtained with a said photographic multicolour material according to the present invention is explained by means of FIG. 3. In the schematic drawing element 10 represents a multicolour original in which the letters B, G and R represent blue, green and red image areas, the black image area is hatched and the colourless image area is left blank. Element 11 represents a multicolour photographic element having three differently spectrally sensitive negative working silver halide emulsion layers viz. a blue-sensitive silver halide emulsion layer 12, a green-sensitive silver halide emulsion layer 14, and a red-sensitive silver halide emulsion layer 16 applied to a support 17. A panchromatic direct-positive working silver halide emulsion layer 13 is present in water-permeable relationship between the blue-sensitive silver halide emulsion layer 12 and the green-sensitive silver halide emulsion layer 14. A panchromatic direct-positive silver halide emulsion layer 15 is present in water-permeable relationship between the green-sensitive silver halide emulsion layer 14 and the red-sensitive silver halide emulsion layer 16.

The blue-, green- and red-sensitive silver halide emulsion layers contain respectively a yellow, magenta and cyan coloured compound which compounds on reduction and under alkaline conditions split off a yellow (Y), magenta (M) and cyan (C) dye moiety respectively.

In the area not struck by light i.e. the area of the photographic material 11 corresponding with the black (hatched) area of the original 10 developing agent(s) is (are) not used up in the reduction of exposed silver halide in the negative working silver halide emulsion layers so that by their reaction with the dye releasing compounds under alkaline conditions yellow, magenta and cyan dye moieties indicated by Y, M and C are split off to form by superposition a black or neutral grey image area on the receptor material (not shown in the drawing). In the direct-positive working emulsion layers 13 and 15 in the area corresponding with the black image area of the original 10 diffusible reducing agent capable of acting as developing agent for the developable silver halide of the direct-positive working silver halide emulsion layers (e.g. 1-phenyl-3-pyrazolidinone) is oxidized and is no longer available in non-oxidized state whereby less dye providing compound is reduced. In this way finally a smaller amount of dye is split off in the non-exposed area than could be without the presence of said direct-positive emulsion layers that oxidize developing agent in correspondence with the non-exposed area. Such results in the receptor element in a reduction of the grey density in the black image parts and actually in a lowering of the neutral density line N of FIG. 1 in correspondence with the black area of the original 10 corresponding with the unexposed area of the photographic material 11.

In a one-third spectrum area (here, the green area (G) is chosen as an example) the panchromatic direct-positive silver halide emulsion layers are exposed whereby their development cannot take place any longer or only to an extent inversely proportional to the light-exposure dose. Such results, compared with what happens in an area corresponding with the blacks of the original, in a larger availability of non-oxidized developing agent and consequently in a higher reduction of dye-releasing compound and thus higher dye release in the area corresponding with a one-third colour area (here the green area).

The positive interimage effect obtained results in a multicolour image with higher colour saturation i.e. more brightness in which the grey image area are less or no longer dominating.

The advantage is particularly outspoken when the development proceeds in the presence of a silver halide solvent forming an alkali-soluble and reducible silver complex compound. Indeed, as described in our copending EUR patent application No. 81 00 787.0 filed July 8, 1981 by Agfa-Gevaert N. V., the silver halide from the unexposed portions of the negative working silver halide emulsion layers and here also of the exposed direct-positive working silver halide emulsion layers is complexed with the silver halide solvent and is reduced by physical development at the site of the already formed silver image. Such is the case for example in the hatched area of layer 14 under the green (G) area of the original. Hereby magenta dye M which could leave that area by reaction with developing agent is not set free because developing agent is more rapidly used up by the combined chemical and physical development than by the chemical development alone. Consequently in that area non-oxidized developing agent(s) is (are) no longer available for reduction of the magneta dye providing compound.

The retaining of magenta dye in that area makes that a more brillant green i.e. less greyish green is obtained in the receptor material for only yellow and cyan are superposed.

The photographic material for producing multicolour images of improved brightness according to the present invention preferably comprises as referred to hereinbefore both between the blue-sensitive and green-sensitive and between the green-sensitive and red-sensitive negative-working silver halide emulsion layers a panchromatically sensitive direct-positive working silver halide emulsion layer.

However, in accordance with the present invention it is possible to apply only one direct-positive silver halide emulsion layer between two of the differently-sensitive negative-working silver halide emulsion layers e.g. to influence the hue of a colour area or to compensate for unwanted side absorptions of the dyes, which is called masking, or to apply a further direct-positive emulsion layer underneath the silver halide emulsion layer most close to the support. Further, it is not necessary that the direct-positive emulsion layer(s) is (are) panchromatically sensitive; they can be sensitive for a particular part of the visible spectrum which in the case of more than one direct-positive emulsion layer is the same or different from that for which the other direct-positive silver halide emulsion layer(s) is (are) sensitive. In this way it is possible not only to improve image-brightness but also to influence the hue of one or more individual colours and/or to obtain masking effects.

As is apparent from the explanation hereinbefore illustrated by means of FIG. 3, the presence of one or more direct-positive silver halide emulsion layers whether spectrally sensitized or not gives always rise to a reduction of the grey density in the receptor material in the area corresponding with the black image area of the original because the amount of released dye(s) constituting the netural density is reduced.

Depending on the spectral sensitivity of the direct positive emulsion layer(s), i.e. depending on whether or not in the direct-positive emulsion layer a developable latent silver image is left in one ore more one-third spectrum areas as referred to above with respect to FIG. 3, the colour(s) corresponding to said one-third spectrum area(s) is (are) influenced. For example if the direct-positive silver halide emulsion layers 13 and 15 of FIG. 3 are only green-sensitive, then only in the area corresponding with the green area of the original these layers will be exposed so that more non-oxidized developing agent remains available which leads to an increased yellow and cyan dye release only in the area corresponding with the green area and thus in more briljant green. In the area corresponding with the black area of the original the amount of released dye is reduced as explained above. As the direct-positive emulsion layers are only green-sensitive, dye release in the areas corresponding with other (blue and red) coloured areas of the originals is also reduced for in correspondence therewith the direct-positive emulsion area are developable and using reductor.

As a further example, a photographic colour diffusion transfer material for multicolour reproduction according to the present invention can have between the negative working red-sensitive silver halide emulsion layer and the negative working green-sensitive silver halide emulsion layer a direct-positive working silver halide emulsion layer, that is only sensitive to blue light, and between the negative working blue-sensitive silver halide emulsion layer and the negative working green-sensitive silver halide emulsion layer a direct-positive working silver halide emulsion layer, that is only sensitive to red light. In this way all colours, except for the green are obtained with increased dye-release (with respect to black) and thus a positive interimage effect for only blue and red results.

With regard to terminology used in the description of the present invention we like to point out that the term "non-diffusing" used herein has the meaning commonly applied to the term in photography and denotes materials that in any practical application do not migrate or wander through organic colloid layers, e.g. gelatin, when permeated with an alkaline medium. The same meaning is to be attached to the term "immobile".

The term "diffusible" as applied to the materials of this invention has the converse meaning and denotes materials having the property of diffusing effectively through the colloid layers of the photographic elements in an alkaline medium. "Mobile" has the same meaning.

By "operative contact" is meant that for producing diffusion transfer of an image-wise released dye or dye precursor compound on applying an alkaline processing liquid in the presence of a photographic silver halide developing agent, said compound releasing a dye or dye precursor can come into chemically reactive contact with unoxidized developing agent in an amount that is controlled by the image-wide developable silver halide of an image-wise photo-exposed silver halide emulsion layer.

The term "negative working emulsion layer" is reserved to silver halide emulsion layers which yield on development a visible silver image in correspondence with the exposed area.

The term "direct-positive working silver halide emulsion layer" is reserved to silver halide emulsion layers that after their image-wise exposure, in the same development conditions as applied for the negative working emulsion layers, yield a visible silver image in correspondence with the non-exposed areas.

By "dye providing compound" is understood a compound wherefrom a dye, a shifted dye or a dye precursor can be set free. Shifted dyes include those compounds whose light-absorption characteristics are shifted hypsochromically or bathochromically when subjected to a different environment such as a change in pH, a reaction with a material to form a complex, a tautomerization, reactions to change the pKa of the compound, a removal of a group such as a hydrolyzable acyl group connected to an atom of the chromophore as mentioned in Weyerts, U.S. Pat. No. 3,260,597 by Stanley R. Seales and Allen E. Wissler, issued July 12, 1966, and the like. In certain embodiments the shifted dyes are highly preferred, especially those containing a hydrolyzable group on an atom affecting the chromophore resonance structure, since the compounds can be incorporated directly in a silver halide emulsion layer or even on the exposure side thereof without substantial reduction of the light that is effective in the exposure of the silver halide. After exposure the dye can be shifted to the appropriate colour such as, e.g., by hydrolytic removal of an acyl group to provide the disired image dye.

The term "dye precursor" refers to those compounds that undergo reactions encountered in a photographic imaging system to produce an image dye such as colour couplers, oxichromic compounds, and the like.

In a preferred embodiment the material of the present invention is developed with a mixture of reducing agents at least one of which is a compound called "electron donor" (ED-compound) and at least one of which is a compound called electron-transfer agent (ETA-compound). The electron-transfer agent is a compound which is a better silver halide reducing agent under alkaline conditions of processing than the electron donor. In those instances where the electron donor is incapable of, or substantially ineffective in developing the silver halide, the ETA-compound functions to develop the silver halide and provides a corresponding image-wise pattern of oxidized electron donor because the oxidized ETA-compound readily accepts electrons from the ED-compound. In unoxidized form the ED-compounds are capable of reducing said non-diffusing dye providing compound in alkaline medium.

The ED-compound is preferably present in non-diffusible state in each negative working silver halide emulsion layer whereas the ETA-compound is used in diffusible form and can be present in the processing liquid or in one or more hydrophilic colloid layers of the photographic material.

In this way the reactions are better separated in their desired sequence in that first the image-wise oxidation of the ETA-compound by the exposed silver halide starts, then the rapid electron transfer to oxidized ETA-compound from the ED-compound takes place, which ED-compound being the less reactive compound where unaffected finally reacts with the dye providing compound to release its dye moiety.

The quoted terms are sufficiently known to those skilled in the art.

Suitable compounds releasing a dye or dye precursor for use according to the present invention are quinonoid compounds described in the U.S. Pat. Nos. 4,139,379 and 4,139,389, in the published European Patent Applications 0 004 399 and 0 038 092, all mentioned hereinbefore, which documents should be read in conjunction herewith.

The image-wise dye release by reduction i.e. by reaction with a non-oxidized developing agent proceeds with one group of useful quinonoid compounds according to the following reaction mechanism illustrated with simplified general formulae of quinonoid compounds (I):

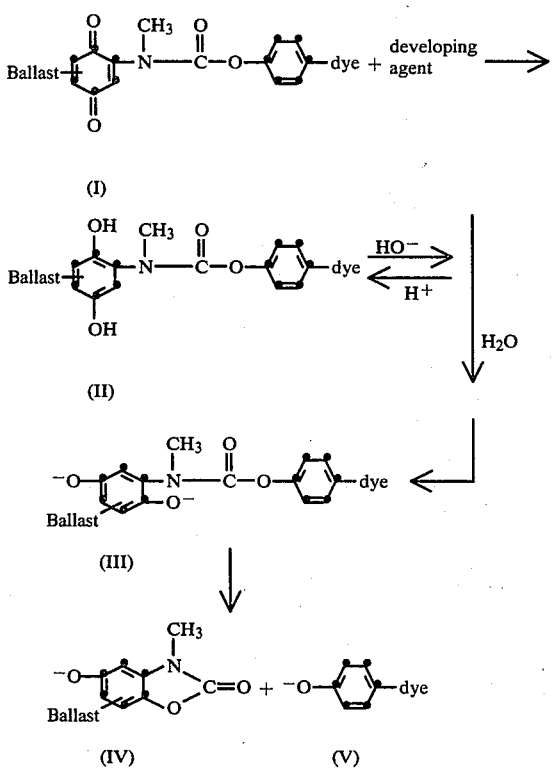

The dye compound (V) is released where the nucleophilic group, here the hydroxyl group of the hydroquinone, can attack the carbamate ester linkage. However, when the nucleophilic group is oxidized, which is the case in the quinone form, nucleophilic displacement is impossible. The compounds of the above formula (I) are referred to in said U.S. Pat. No. 4,139,379 as BEND-compounds wherein BEND is an acronym for Ballasted Electron-accepting Nucleophilic Displacement.

As is known in the art, "ballast" stands for ballasting group, which group makes the molecule immobile. The ballasting group may be present as a substituent on the quinone nucleus. Thus, said BEND-compounds used according to the present invention as dye providing compounds are ballasted compounds capable of undergoing an electron-accepting nucleophilic displacement reaction separating hereby in alkaline medium a diffusible dye or dye precursor moiety.

Other particularly suitable quinonoid compounds releasing a dye or dye precursor for use according to the present invention are described in the published European Patent Application 0 004 399. In the latter Application ballasted quinone-type or quinonoid compounds are described, which compounds by reduction yield hydroquinone type compounds that through the action of alkali (HO−) are split into a ballasted quinone methide compound and a diffusible compound containing a dye or dye precursor moiety.

The image-wise dye release by reaction with a developing agent proceeds according to the following reaction mechanism illustrated with simplified general formulae of quinonoid compound (I)[1]

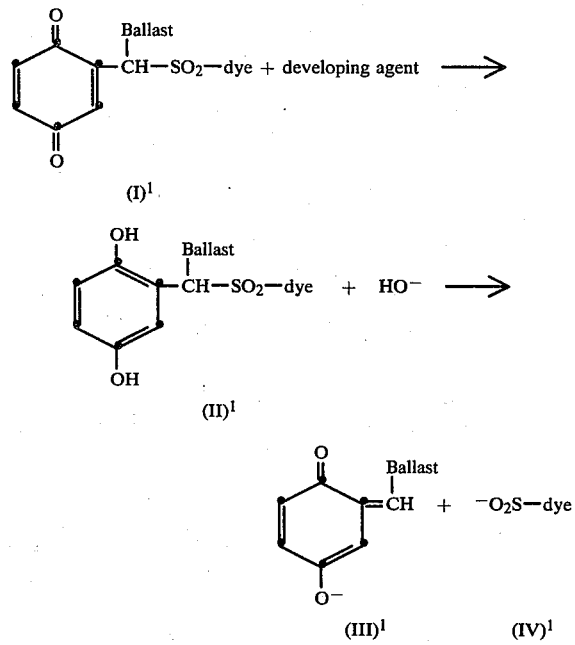

The above BEND-compounds and quinone-methide-yielding compounds are so-called IHR-compounds i.e. compounds of which the hydrolysability increases by reduction, wherein IHR is the acronym for "Increased Hydrolysis by Reduction". The above IHR-compounds release in reduced state under alkaline conditions a diffusible dye or dye precursor moiety.

According to one embodiment of this invention the above process is carried out with a photographic material containing a panchromatic direct-positive silver halide emulsion layer between at least two differently spectrally sensitive negative working silver halide emulsion layers and a different IHR-compound in operative contact with a corresponding silver halide emulsion layer. The IHR-compound comprises a dye-providing moiety, which includes a dye, a shifted dye or a dye precursor such as an oxichromic compound or a colour coupler.

Suitable dyes are e.g. azo dyes, azomethine (imine) dyes, anthraquinone dyes, alizarine dyes, merocyanine dyes, quinoline dyes, cyanine dyes and the like.

When colour couplers are used as dye-precursor they can be released in areas where no development occurs and can diffuse to an adjacent layer where they can be made to react with an oxidized colour developer such as an oxidized primary aromatic amine to form the image dye. Generally, the colour coupler and the colour developer are chosen so that the reaction product is immobile. Typical useful colour couplers include the pyrazolone couplers, pyrazolotriazole couplers, open-chain ketomethylene couplers, phenolic couplers and the like. Further reference to the description of appropriate couplers is found in U.S. Pat. No. 3,620,747 of John C. Marchant and Robert F. Motter, issued Nov. 16, 1971, which is incorporated herein by reference.

The compounds containing oxichromic moieties can be advantageously used in a photographic system since they are generally colourless materials because of the absence of an image-dye chromophore. Thus, they can be used directly in a photographic emulsion layer on the exposure side thereof without competitive light absorption. Compounds of this type are those compounds that undergo chromogenic oxidation to form the respective image dye. The oxidation can be carried out by aerial oxidation, incorporation of oxidants into the photographic element or film unit, or use of an oxidant during processing. Compounds of this type have been referred to in the art as leuco compounds, i.e. compounds that have no colour. Typical useful oxichromic compounds include leuco indoanilines, leuco indophenols, leuco anthraquinones and the like.

The non-diffusing dye providing compound can be present in a layer adjacent to the negative-working silver halide emulsion layer as shifted dye or colourless dye precursor in the said silver halide emulsion layer itself. In the case of the use of a shifted dye the colour of the dye is preferably chosen such that the predominating absorption range of the dye providing compound does not correspond with the predominating sensitivity range of the silver halide emulsion layer with which it is associated.

In the process of the present invention a silver halide developing agent is used that has sufficient reducing power to reduce photoexposed silver halide of a negative working emulsion at a rate faster than in the reduction of the applied IHR-compounds.

Photographic silver halide developing agents suitable for that purpose can be found by simple tests by using them in combination with an elected set of silver halide and IHR-compound.

Typical useful silver halide developing agents applicable in the present invention include: hydroquinone compounds, 1-arylpyrazolidin-3-one compounds, pyrogallol and substituted pyrogallol compounds and ascorbic acid or mixtures thereof.

As already referred to hereinbefore, it is preferred to carry out the colour diffusion transfer process with a mixture of reducing agents at least one of which is a compound called electron donor (ED-compound) and at least one of which is a compound called electron-transfer agent (ETA-compound).

The ED-compounds are preferably non-diffusing e.g. therefor provided with a ballasting group so that they remain within the layer unit wherein they have to transfer their electrons to the dye providing compound.

The ED-compound is preferably present in non-diffusible state in each negative working silver halide emulsion layer containing a different non-diffusible dye or dye precursor. Examples of such ED-compound are ascorbyl palmitate and 2,5-bis(1',1',3',3'-tetramethylbutyl)-hydroquinone. Other ED-compounds are disclosed in U.S. Pat. No. 4,139,379, already mentioned hereinbefore and in the published German Patent Application 2,947,425 filed Nov. 24, 1979 by Agfa-Gevaert A. G. ED-precursor compounds are disclosed in the published German Patent Application 3,006,268 filed Feb. 20, 1979 by Agfa-Gevaert A. G.

The ETA-compound is preferably used as developing agent in diffusible state and is, e.g., incorporated in mobile form in (a) hydrophilic colloid layer(s) adjacent to one or more silver halide emulsion layers or applied from the processing liquid for the dye diffusion transfer.

A diffusible ETA-compound is preferably incorporated in the direct-positive silver halide emulsion layers adjacent to one or more negative working silver halide emulsion layers.

Typically useful ETA-compounds also diffusing in oxidized state are 3-pyrazolidinone compounds such as 1-phenyl-3-pyrazolidinone, 1-phenyl-4,4-dimethyl-3-pyrazolidinone, 4-hydroxymethyl-4-methyl-1-phenyl-3-pyrazolidinone, 1-m-tolyl-3-pyrazolidinone, 1-p-tolyl-3-pyrazolidinone, 1-phenyl-4-methyl-3-pyrazolidinone, 1-phenyl-5-methyl-3-pyrazolidinone, 1-phenyl-4,4-bis-(hydroxymethyl)-3-pyrazolidinone, 1,4-dimethyl-3-pyrazolidinone, 4-methyl-3-pyrazolidinone, 4,4-dimethyl-3-pyrazolidinone, 1-(3-chlorophenyl)-4-methyl-3-pyrazolidinone, 1-(4-chlorophenyl)-4-methyl-3-pyrazolidinone, 1-(3-chlorophenyl)-3-pyrazolidinone, 1-(4-chlorophenyl)-3-pyrazolidinone, 1-(4-tolyl)-4-methyl-3-pyrazolidinone, 1-(2-tolyl)-4-methyl-3-pyrazolidinone, 1-(4-tolyl)-3-pyrazolidinone, 1-(3-tolyl)-3-pyrazolidinone, 1-(3-tolyl)-4,4-dimethyl-3-pyrazolidinone, 1-(2-trifluoroethyl)-4,4-dimethyl-3-pyrazolidinone, 5-methyl-3-pyrazolidinone and the like. A combination of different ETA's such as those disclosed in U.S. Pat. No. 3,039,869 of Howard G. Rogers and Harriet W. Lutes, issued June 19, 1962, can also be employed. Such developing agents can be employed in the liquid processing composition or may be contained, at least in part, in any layer or layers of the photographic element or film unit such as the silver halide emulsion layers, the dye image-providing material layers, interlayers, image-receiving layer, etc. The particular ETA selected will, of course, depend on the particular electron donor and IHR-compound used in the process and the processing conditions for the particular photographic element.

The concentration of ED-compound in the photographic material may vary within a broad range but is, e.g., in the molar range of 1:2 to 4:1 with respect to the non-diffusing dye or dye precursor compound. The ETA-compound may be present in the alkaline aqueous liquid used in the development step, but is used preferably in diffusible form in non-photosensitive hydrophilic colloid layers adjacent to at least one silver halide emulsion layer. The concentration of the ETA-compound in the photographic material is preferably in the same molar range as wherein the ED-compound is applied.

Migration of non-oxidized developing agent, e.g. acting as ETA-compound, proceeds non-image-wise and will have an adverse effect on correct colour rendering when surplus developing agent remains unoxidized in the photoexposed area of a negative working emulsion layer. Therefore, according to a preferred embodiment of the present invention a silver halide solvent is used to mobilize unexposed silver halide in complexed form for helping to neutralize (i.e. oxidize by physical development) migrated developing agent in the photoexposed area wherein unaffected developing agent (ETA-compound) should no longer be available for reacting with the IHR-compound directly or through the applied ED-compound.

The more extensive developer exhaustion that takes place with the transferred silver complex in the photoexposed areas prevents dye release from the photoexposed areas so that dye images with higher colour saturation, i.e. more bright colour images, are obtained.

As is known to those skilled in the art of silver halide photography, a considerable number of compounds form alkali-soluble complexes with silver ions. Among the many silver halide solvents may be mentioned thiosulphates, thiocyanates, thiosugars, thioetheracids e.g. $HOOC—(CH_2—S—CH_2)_3—COOH$ or an active methylene compound having the methylene group linked directly to sulphonyl groups as e.g. in $H_3C—SO_2—CH_2SO_2—CH_3$. Preferably used are, however, water-soluble thiosulphates (particularly alkali metal thiosulphate or ammonium thiosulphate).

According to one embodiment the silver halide solvent acting as silver-ion-complexing agent is applied in the alkaline aqueous liquid that is used in the development step. A useful concentration of silver halide solvent, e.g. sodium thiosulphate, in said liquid is in the range of 0.1 g to 40 g per liter.

According to a special embodiment the complexing agent is set free in the presence of alkali from a precursor compound present in the photographic material during development. Precursor compounds, which in the presence of alkali release a diffusible photographic reagent such as a silver halide solvent, are described in the U.S. Pat. No. 3,698,898 by J. Michael Grasshoff and Lloyd D. Taylor, issued Oct. 17, 1972. Such precursor compounds, which in the presence of alkali are capable of splitting off a silver halide solvent compound, correspond to the following general formula:

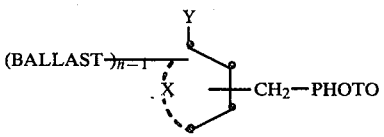

wherein

X represents the atoms necessary to complete a benzene or naphthalene nucleus,

Y is hydroxy or a substituent that upon hydrolysis provides hydroxy, PHOTO represents a silver halide solvent moiety, e.g. a —S—$SO_3M$ group wherein M is an alkali metal or onium group, e.g. ammonium group, BALLAST is a ballasting group rendering said compound less diffusible in a water-permeated hydrophilic colloid layer than it would be without said group, and n is 1 or 2.

According to an embodiment said precursor compound is incorporated in the receiving layer of the receptor material wherefrom it can reach the contacting photoexposed photographic multilayer multicolour material upon alkaline treatment. According to another embodiment said precursor compound is incorporated in the photographic material, e.g. in the layer also containing diffusible developing agent (ETA-compound) and/or in the silver halide emulsion layers themselves. The rate of release of the silver halide solvent may be controlled by selection of the appropriate Y substituent, e.g. in the form of an ester group, which hydrolyses more or less rapidly. In the —$CH_2$— group of the above general formula one or both of the hydrogen atoms may be substituted by a hydrocarbon group, e.g. an alkyl group such as methyl or ethyl.

The photosensitive silver halide in the negative and positive working silver halide emulsion layers used in the process of the present invention is preferably a silver halide of the group of silver chloride, silver bromide, silver bromoiodide, silver chlorobromoiodide and the like, or mixtures thereof. The emulsions may be coarse- or fine-grain and can be prepared by any of the well-known procedures, e.g., single-jet emulsions, double-jet emulsions. They may be Lippmann emulsions, ammoniacal emulsions, thiocyanate- or thioether-ripened emulsions such as those described in U.S. Pat. Nos. 2,222,264 of Adolph H. Nietz and Frederick J. Russell, issued Nov. 19, 1540, 3,320,069 of Bernard D. Illingsworth, issued May 16, 1967, and 3,271,157 of Clarence E. McBride, issued Sept. 6, 1966. Surface-image emulsions or internal-image emulsions may be used such as those described in U.S. Pat. Nos. 2,592,250 of Edward Philip Davey and Edward Bowes Knott, issued Apr. 8, 1952, 3,206,313 of Henry D. Porter, Thomas H. James and Wesley G. Lowe, issued Sept. 14, 1965, and 3,447,927 of Robert E. Bacon and Jean F. Barbier, issued June 3, 1969. The emulsions may be regular-grain emulsions such as the type described by Klein and Moisar in J.Photogr.Sci., Vol. 12, No. 5, Sept./Oct., 1964, pp. 242–251. If desired, mixtures of surface- and internal-image emulsions may be used as described in U.S. Pat. No. 2,996,382 of George W. Luckey and John C. Hoppe, issued Aug. 15, 1961.

Negative-working emulsions are silver halide emulsions sufficiently known to those skilled in the art. A description of the composition and preparation of a large variety of such emulsions also called "negative emulsions" is presented by Pierre Glafkides in his book "Photographic Chemistry" Fountain Press-London, Vol. 1, 1st ed. (1958) p. 327–336, and further under the heading "Slow Emulsions" on p. 337–354. Direct-positive emulsions are described in the same book at pages 355–356.

In principle all direct-positive silver halide emulsions are suited that produce a positive silver image and a corresponding image-wise distribution of developing agent oxidation products during the development of the negative silver halide emulsion layers. For example the direct-positive working silver halide emulsion layers are those silver halide emulsions wherein by exposure or by a chemical treatment a developable fog has been produced, which fog is image-wise destroyable by image-wise photo-exposure in the spectral sensitivity range of said emulsion layers. In the unexposed areas the fog is maintained so that during the subsequent development a direct-positive silver image is obtained and in correspondence therewith an image-wise distribution of oxidized developing agent.

Direct-positive silver halide emulsions containing developable, fogged silver halide grains are well-known and described e.g. in U.S. Pat. No. 2,541,472 of George D. Hill, issued Feb. 13, 1951, GB Pat. No. 723,019 filed Feb. 5, 1952 by Gevaert Photo-Produkten N. V., U.S. Pat. Nos. 3,501,307 of Bernard D. Illingsworth, issued Mar. 17, 1970, 3,367,778 of Robert W. Berriman, issued Feb. 6, 1968, GB Pat. No. 1,452,301 filed Dec. 8, 1972 by Agfa-Gevaert N. V., and GB Pat. No. 1,427,525 filed July 13, 1972 by Agfa-Gevaert N. V.

Further details about emulsion composition, preparation and coating are described, e.g. in Product Licensing Index, Vol. 92, December 1971, publication 9232, p. 107–109.

Generally speaking, the silver halide emulsion layers in the invention comprise photosensitive silver halide dispersed in gelatin and are about 0.2 to 2 μm thick. Preferably the dye image-providing materials are dispersed in the negative working emulsions.

The negative emulsions can be chemically sensitized, e.g. by adding sulphur-containing compounds, e.g. allyl isothiocyanate, allyl thiourea, sodium thiosulphate and the like, during the chemical ripening stage. Also reducing agents, e.g. the tin compounds described in the Belgian Patent specification Nos. 493,464 filed Jan. 24, 1950 and 568,687 filed June 18, 1958, both by Gevaert Photo-Production N. V., and polyamines such as diethylenetriamine or derivatives of aminomethanesulphonic acid, e.g. according to the Belgian Patent specification No. 547,323 filed Apr. 26, 1956 by Gevaert Photo-Producten N. V., can be used as chemical sensitizers. Other suitable chemical sensitizers are noble metals and noble metal compounds such as gold, platinum, palladium, iridium, ruthenium and rhodium. This method of chemical sensitization has been described in the article of R. KOSLOWSKY, Z.Wiss.Photogr.Photophys.-Photochem. 46, 65–72 (1951).

Further it is possible to sensitize the emulsions with polyalkylene oxide derivatives, e.g. with polyethylene oxide having a molecular weight between 1000 and 20,000, or with condensation products of alkylene oxides and aliphatic alcohols, glycols, cyclic dehydration products of hexitols, alkyl-substituted phenols, aliphatic carboxylic acids, aliphatic amines, aliphatic diamines and amides. The condensation products have a molecular weight of at least 700, preferably of more than 1000. For obtaining special effects these sensitizers of course can be combined with each other as described in Belgian Patent specification No. 537,278 filed Apr. 12, 1955 and UK Patent Specification No. 727,982 filed Feb. 5, 1952, both by Gevaert Photo-Producten N. V.

The emulsions can be spectrally sensitized, e.g. by the usual mono- or polymethine dyes such as acidic or basic cyanines, hemicyanines, oxonols, hemioxonols, styryl dyes or others, also tri- or polynuclear methine dyes, e.g. rhodacyanines or neocyanines. Such sensitizers are described, e.g., by F. M. HAMER in "The Cyanine Dyes and Related Compounds" (1964) Interscience Publishers, John Wiley & Sons, New York.

The negative emulsions may contain the usual stabilizers such as, e.g., homopolar or salt-like compounds of mercury with aromatic or heterocyclic rings such as mercaptotriazoles, simple mercury salts, sulphonium mercury double salts and other mercury compounds. Other suitable stabilizers are azaindenes, preferably tetra- or penta-azaindenes, especially those substituted with hydroxyl or amino groups. Compounds of this kind are described by BIRR in Z.Wiss.Photgr.Photophys.Photochem. 47, 2–27 (1952). Still other suitable sensitizers are among others heterocyclic mercapto compounds, e.g. phenylmercaptotetrazole, quaternary benzothiazole derivatives, benzotriazole and the like.

As binding agent for the photographic layers preferably gelatin is used. However, it can be replaced wholly or partially by other natural or synthetic binding agents. Examples of natural binding agents are alginic acid and its derivatives such as salts, esters and amides, cellulose derivatives such as carboxymethylcellulose, alkylcellulose such as hydroxyethylcellulose, starch and its derivatives such as ethers or esters, or carragenates. Examples of synthetic binding agents are polyvinyl alcohol, partially saponified polyvinyl acetate, polyvinylpyrrolidone and the like.

Hardening of the layers can occur in the usual way, e.g. with formaldehyde or halogenated aldehydes containing a carboxyl group such as mucobromic acid, diketones, methanesulphonic acid esters, dialdehydes.

For carrying out the dye diffusion transfer process according to the present invention preferably a two-sheet system is used, which consists of a light-sensitive element containing one or more silver halide emulsion layers and the non-migratory colour-providing compounds associated therewith and of a separate image-receiving element wherein the desired colour image is produced by the image-wise transferred diffusing dyes. For that purpose a firm contact between the light-sensitive element and the image-receiving element is necessary for a finite period of time during development. In this way the produced image-wise distribution of diffusing dyes produced in the light-sensitive element as a result of development can be transferred to the image-receiving element. The contact is made after the development has been started.

For carrying out the dye diffusion transfer process also a material can be used wherein the light-sensitive element and the image-receiving element form an integral unit; it is also called a one-sheet material. A separation of the light-sensitive element from the image-receiving element after terminating the process of development, even after the dye transfer, is not necessary. Such an embodiment is described, e.g., in the published German Patent Application 2,019,430 filed Apr. 22, 1970 by Agfa-Gevert A. G.

The support for the photographic elements used in this invention may be any material as long as it does not deleteriously affect the photographic properties of the film unit and is dimensionally stable. Typical flexible sheet materials are paper supports, e.g. coated at one or both sides with an $\alpha$-olefin polymer, e.g. polyethylene, or film supports e.g. cellulose nitrate film, cellulose acetate film, poly(vinyl acetal) film, polystyrene film, poly(ethylene terephthalate) film, polycarbonate film, poly-$\alpha$-olefins such as polyethylene and polypropylene film, and related films of resinous materials. The support is usually about 0.05 to 0.15 mm thick.

In a photographic material for use according to the invention and containing two or more silver halide emulsion layers, each silver halide emulsion layer containing a dye-providing compound or having the dye image-providing compound present in a contiguous layer may be separated from the other silver halide emulsion layer(s) in the film unit by (an) interlayer(s), including e.g. gelatin, calcium alginate, or any of the colloids disclosed in U.S. Pat. No. 3,384,483 of Richard W. Becker, issued May 21, 1968, polymeric materials such as polyvinylamides as disclosed in U.S. Pat. No. 3,421,892 of Lloyd D. Turner, issued Jan. 14, 1969, or any of those disclosed in French Patent Specification No. 2,028,236 filed Jan. 13, 1970 by Polaroid Corporation or U.S. Pat. Nos. 2,992,104 of Howard C. Haas, issued July 11, 1961 and 3,427,158 of David P. Carlson and Jerome L. Reid, issued Feb. 11, 1969.

The interlayers are permeable to alkaline solutions, and are 1 to 5 $\mu$m thick. Of course these thicknesses are approximate only and may be modified according to the product desired.

According to an embodiment for correct spectral exposure of a multicolour dye diffusion transfer material for use according to the present invention, a water-permeable colloid interlayer dyed with a yellow non-diffusing dye is applied below the blue-sensitive silver halide emulsion layer containing a yellow dye-releasing compound and a water-permeable colloid interlayer dyed with a magenta non-diffusing dye is applied below the green-sensitive silver halide emulsion layer containing the magenta dye-releasing compound.

The image-receiving material used in this invention has the desired function of mordanting or otherwise fixing the dye images transferred from the photosensitive element. The particular material chosen will, of course, depend upon the dye to be mordanted. If acid dyes are to be mordanted, the image-receiving layer can be composed of, or contain basic polymeric mordants such as polymers of aminoquanidine derivatives of vinyl methyl ketone such as described in U.S. Pat. No. 2,882,156 of Louis M. Minsk, issued Apr. 14, 1959, and basic polymeric mordants and derivatives, e.g. poly-4-vinylpyridine, the 2-vinylpyridine polymer metho-p-toluene sulphonate and similar compounds described in U.S. Pat. No. 2,484,430 of Robert H. Sprague and Leslie G. Brooker, issued Oct. 11, 1949, the compounds described in the published German Patent Application No. 2,200,063 filed Jan. 11, 1971 by Agfa-Gevaert A. G. Suitable mordanting binders include, e.g. guanylhydrazone derivatives of acyl styrene polymers, as described, e.g., in published German Patent Specification No. 2,009,498 filed Feb. 28, 1970 by Agfa-Gevaert AG. In general, however, other binders, e.g. gelatin, would be added to the last-mentioned mordanting binders. Effective mordanting compositions are long-chain quaternary ammonium or phosphonium compounds or ternary sulphonium compounds, e.g. those described in U.S. Pat. Nos. 3,271,147 of Walter M. Bush and 3,271,148 of Keith E. Whitmore, both issued Sept. 6, 1966, and cetyltrimethym-ammonium bromide. Certain metal salts and their hydroxides that form sparingly soluble compounds with the acid dyes may be used too. The dye mordants are dispersed in one of the usual hydrophilic binders in the image-receiving layer, e.g. in gelatin, polyvinylpyrrolidone or partly or completely hydrolysed cellulose esters.

Generally, good results are obtained when the image-receiving layer, which is preferably permeable to alkaline solutions, is transparent and about 4 to about 10 μm thick. This thickness, of course, can be modified depending upon the result desired. The image-receiving layer may also contain ultraviolet-absorbing materials to protect the mordanted dye images from fading, brightening agents such as the stilbenes, coumarins, triazines, oxazoles, dye stabilizers such as the chromanols, alkylphenols, etc.

According to a particular embodiment the photosensitive material is made suitable for in-camera processing. Therefor the receiving layer is integral with the photographic material and is arranged in water-permeable relationship with the silver halide hydrophilic colloid emulsion layers. For that purpose the photosensitive silver halide emulsion layers are applied to the same support as the receptor layer so as to form an integral combination of light-sensitive layer(s) and a non light-sensitive layer receiver element preferably with an opaque layer, which is alkali-permeable, reflective to light and located between the receptor layer and the set of silver halide emulsion layers. In a process using such material the alkaline processing composition may be applied between the outer photosensitive layer of the photographic element and a cover sheet, which may be transparent and superposed before exposure.

To form the opaque layer an opacifying agent can be applied from a processing composition. Examples of opacifying agents include carbon black, barium sulphate, zinc oxide, barium stearate, silicates, alumina, zirconium oxide, zirconium acetyl acetate, sodium zirconium sulphate, kaolin, mica, titanium dioxide, organic dyes such as indicator dyes, nigrosines, or mixtures thereof in widely varying amounts depending upon the degree of opacity desired. In general, the concentration of opacifying agent should be sufficient to prevent further exposure of the film unit's silver halide emulsion or emulsions by ambient actinic radiation through the layer of processing composition, either by direct exposure through a support or by light piping from the edge of the element. For example, carbonblack or titanium dioxide will generally provide sufficient opacity when they are present in the processing solution in an amount of from about 5 to 40% by weight. After the processing solution and opacifying agent have been distributed into the film unit, processing may take place out of the camera in the presence of actinic radiation in view of the fact that the silver halide emulsion(s) of the laminate is (are) appropriately protected against incident radiation, at one major surface by the opaque processing composition and at the remaining major surface by the opaque layer that is permeable to alkaline solutions. In certain embodiments, ballasted indicator dyes or dye precursors can be incorporated in a layer on the exposure side of the photosensitive layers; the indicator dye is preferably transparent during exposure and becomes opaque when contacted with the processing composition. Opaque binding tapes can also be used to prevent edge leakage of actinic radiation incident on the silver halide emulsion.

When titanium dioxide or other white pigments are employed as the opacifying agent in the processing composition, it may also be desirable to employ in cooperative relationship therewith a pH-sensitive opacifying dye such as a phthalein dye. Such dyes are light-absorbing or coloured at the pH at which image formation is effected and colourless or not light-absorbing at a lower pH. Other details concerning these opacifying dyes are described in French Patent specification No. 2,026,927 filed Dec. 22, 1969 by Polaroid Corporation.

The substantially opaque, light-reflective layer, which is permeable to alkaline solutions, in the receiver part of integral film units suited for use in the present invention can generally comprise any opacifier dispersed in a binder as long as it has the desired properties. Particularly desirable are white light-reflective layers since they would be esthetically pleasing backgrounds on which to view a transferred dye image and would also possess the optical properties desired for reflection of incident radiation. Suitable opacifying agents include, as already mentioned with respect to the processing composition, titanium dioxide, barium sulphate, zinc oxide, barium stearate, silver flake, silicates, alumina, zirconium oxide, zirconium acetyl acetate, sodium zirconium sulphate, kaolin, mica or mixtures thereof in widely varying amounts depending upon the degree of opacity desired. The opacifying agents may be dispersed in any binder such as an alkaline solution-permeable polymeric matrix such as, for example, gelatin, polyvinyl alcohol, and the like. Brightening agents such as the stilbenes, coumarins, triazines and oxazoles may also be added to the light-reflective layer, if desired. When it is desired to increase the opacifying capacity of the light-reflective layer, dark-coloured opacifying agents may be added to it, e.g., carbon black, nigrosine dyes, etc. Another technique to increase the opacifying capacity of the light-reflective layer is to employ a separate opaque layer underneath it comprising, e.g., carbon black, nigrosine dyes, etc., dispersed in a polymeric matrix that is permeable to alkaline solutions such as, e.g., gelatin, polyvinyl alcohol, and the like. Such an opaque layer should generally have a density of at least 4 and preferably greater than 7 and should be substantially opaque to actinic radiation. The opaque layer may also be combined with a developer scavenger layer if one is present. The light-reflective and opaque layers are generally 0.025 to 0.15 mm in thickness, although they can be varied depending upon the opacifying agent employed, the degree of opacity desired, etc.

Use of pH-lowering material in the dye-imaging-receiving element of an integral film unit for use according to the invention usually increase the stability of the transferred image. Generally, the pH-lowering material will effect a reduction of the pH of the image layer from about 13 or 14 to at least 11 and preferably 5–8 within a short time after imbibition. For example, polymeric acids as disclosed in U.S. Pat. No. 3,362,819 of Edwin H. Land, issued Jan. 9, 1968 or solid acids or metallic salts, e.g. zinc acetate, zinc sulphate, magnesium acetate, etc., as disclosed in U.S. Pat. No. 2,584,030 of Edwin H. Land, issued Jan. 29, 1952, may be employed with good results. Such pH-lowering materials reduce the pH of the film unit after development to terminate development and substantially reduce further dye transfer and thus stabilize the dye image.

An inert timing or spacer layer may be employed in practice over the pH-lowering layer, which "times" or controls the pH reduction depending on the rate at which alkali diffuses through the inert spacer layer. Examples of such timing layers include gelatin, polyvinyl alcohol or any of the colloids disclosed in U.S. Pat. No. 3,455,686 of Leonard C. Farney, Howard G. Rogers and Richard W. Young, issued July 15, 1969. The timing layer may be effective in evening out the various reaction rates over a wide range of temperatures, e.g., premature pH reduction is prevented when imbibition is effected at temperatures above room temperature, e.g. at 35° to 37° C. The timing layer is usually about 2.5 μm to about 18 μm thick. Especially good results are obtained when the timing layer comprises a hydrolysable polymer or a mixture of such polymers that are slowly hydrolysed by the processing composition. Examples of such hydrolysable polymers include polyvinyl acetate, polyamides and cellulose esters.

An alkaline processing composition employed in this invention may be a conventional aqueous solution of an alkaline material, e.g. sodium hydroxide, sodium carbonate or an amine such as diethylamine. Independent from the use of the silver halide solvent or in admixture therewith improved dye densities are obtained in the dye diffusion transfer process applying IHR-compounds when the alkaline processing liquid contains a saturated, aliphatic or alicyclic amino alcohol having from 2 to 10 carbon atoms and at least two hydroxy groups. Particularly high dye densities are obtained when using in said processing liquid triisopropanolamine. Other suitable dye density improving solvents, optionally used in admixture, are dimethylformamide, N-methyl-2-pyrrolidinone and an aliphatic or cycloaliphatic hydroxy compound being e.g. a mono-alcohol, diol or triol that is not completely miscible with water at 20° C. Preferred examples thereof are n-butanol, isobutanol, 2,2-diethyl-propane-1,3-diol, 1-phenylethane-1,2-diol (styrene glycol), 2,2,4,4-tetramethylbutane-1,3-diol, 2-ethyl-hexane-1,3-diol and 1,4-cyclohexane-dimethanol.

Preferably the pH of the processing composition is at least 11. The processing composition may contain the above defined silver halide solvent compound. The latter may be contained in a silver halide solvent precursor compound applied in the photographic material and/or receptor material.

According to one embodiment the alkaline processing liquid contains a diffusible developing agent e.g. ascorbic acid or a 3-pyrazolidinone developing agent such as 1-phenyl-4-methyl-3-pyrazolidinone serving e.g. as ETA-compound for effecting the reduction of the exposed and complexed silver halide.

The alkaline processing composition employed in this invention may also contain a desensitizing agent such as methylene blue, nitro-substituted heterocyclic compounds, 4,4'-bipyridinium salts, etc., to insure that the photosensitive element is not further exposed after it is removed from the camera for processing.

The solution also preferably contains a viscosity-increasing compound such as a high-molecular-weight polymer, e.g. a water-soluble ether inert to alkaline solutions such as hydroxyethylcellulose or alkali metal salts of carboxymethylcellulose such as sodium carboxymethylcellulose. A concentration of viscosity-increasing compound of about 1 to about 5% by weight of the processing composition is preferred. It will impart thereto a viscosity of about 100 mPa.s to about 200,000 mPa.s.

Processing of separatable photographic material and dye-receiving material may proceed in a tray developing unit as is present, e.g. in an ordinary silver complex diffusion transfer (DTR) apparatus in which contacting with the separate dye image-receiving material is effected after a sufficient absorption of processing liquid by the photographic material has taken place. A suitable apparatus for said purpose is the COPYPROOF CP 38 (trade name) DTR-developing apparatus. COPYPROOF is a trade name of Agfa-Gevaert, Antwerp-/Leverkusen.

According to the other embodiments wherein the receptor layer is integral with the photosensitive layer(s) the processing liquid is applied e.g. from a rupturable container or by spraying.

The rupturable container may be of the type disclosed in U.S. Pat. Nos. 2,543,181 of Edwin H. Land, issued Feb. 27, 1951, 2,643,886 of Ulrich L. di Ghilini, issued June 30, 1953, 2,653,732 of Edwin H. Land, issued Sept. 29, 1953, 2,723,051 of William J. McCune Jr., issued Nov. 8, 1955, 3,056,492 and 3,056,491, both of John E. Campbell, issued Oct. 2, 1962, and 3,152,515 of Edwin H. Land, issued Oct. 13, 1964. In general such containers comprise a rectangular sheet of fluid- and air-impervious material folded longitudinally upon itself to form two walls that are sealed to one another along their longitudinal and end margins to form a cavity in which processing solution is contained.

While the alkaline processing composition used in this invention can be employed in a rupturable container, as described previously, to facilitate conveniently the introduction of processing composition into the film unit, other means of discharging processing composition within the film unit could also be employed, e.g., means injecting processing solution with communicating members similar to hypodermic syringes, which are attached either to a camera or camera cartridge, as described in U.S. Pat. No. 3,352,674 of Donald M. Harvey, issued Nov. 14, 1967.

The following comparative example illustrates and confirms the possibility to obtain an interimage effect useful in the present photographic material. All percentages and ratios are by weight, unless otherwise mentioned.

EXAMPLE

Preparation of comparative material I

A subbed polyethylene terephthalate support having a thickness of 0.1 mm was coated in the mentioned order with the following coating compositions (1) and (2):

| Coating composition (1) | |
|---|---|
| 5% aqueous solution of gelatin | 20 g |
| cyan dye-providing quinonoid compound C (applied from a dispersion A prepared as described hereinafter) | 5 g |
| 2,5-bis(1',1',3',3'-tetramethylbutyl)-hydroquinone (applied from a dispersion B prepared as described hereinafter) | 1.5 g |
| distilled water | 36 ml |
| HOSTAPON T (Registered Trade Mark of Farbwerke Hoeschst A.G. Frankfurt-M, W. Germany, for the wetting agent oleyl-N—methyltauride) | 0.25 ml |

The coating composition (1) was applied at a wet coverage of 63 g per sq.m and dried.

| Coating composition (2) | |
|---|---|
| Aqueous 20% solution of gelatin | 20 g |
| 5% aqueous solution of $F_{17}C_8SO_3^-.N^+(C_2H_5)_4$ | 1 ml |
| water | 79 ml |

The coating composition (2) was applied at a wet coverage of 50 g per sq.m to the dried coating (1) and dried at room temperature.

Preparation of comparative material II

Material B was prepared in the same way as material I with the difference, however, that between layer (1) and layer (2) a direct-positive silver halide emulsion was applied prepared as described in Example 1 (sample 1*a*) of United Kingdom Patent Specification 1,427,525. The coating of the direct-positive emulsion containing pinacryptol yellow as electron-acceptor and a spectral sensitizer for green light proceeded at a coverage of silver bromide corresponding with 0.5 g of silver nitrate per sq.m.

Preparation of the dispersion A including cyan dye-providing compound C according to the following structural formula:

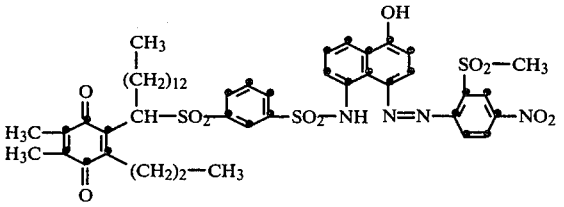

Compound C was prepared analogously to compound 39 of European Patent Application 0 004 399, already mentioned hereinbefore. 200 g of compound C were dissolved in 1000 ml of ethylacetate and dispersed in 3300 ml of water, 300 g of gelatin and dispersed in 3300 ml of water, 300 g of gelatin and 200 ml of a 40% aqueous solution of LOMAR D (trade name) as wetting agent (LOMAR D is a trade name of Nopco Chemical Company, Newark, N.J., U.S.A. for a naphthalene sulphonate condensate, formaldehyde being used in the condensation reaction). The ethyl acetate was removed by evaporation under reduced pressure.

Preparation of the dispersion B 500 g of 2.5-bis(1',1',3',3'-tetramethylbutyl)-hydroquinone was dissolved in 1000 ml of a solvent mixture containing 50% of ethyl acetate and the monoester of cyclohexanol and pentadecylsuccinic acid (50/50 by volume) in diethylcarbonate and dispersed in 7500 ml of water containing 500 g of gelatin and 500 ml of a 40% aqueous solution of LOMAR D (trade name). The ethyl acetate was removed by evaporation under reduced pressure.

Preparation of comparative material III

A subbed polyethylene terephthalate support having a thickness of 0.1 mm was coated in the mentioned order with the following coating compositions (1*a*) and (2*a*).

| Coating composition (1a) | |
|---|---|
| 5% aqueous solution of gelatin | 10 g |
| cyan dye-providing quinonoid compound C (applied from the dispersion A prepared as described above) | 5 g |
| 2.5-bis(1',1',3',3'-tetramethylbutyl)hydroquinone (applied from a dispersion B prepared as described above) | 1.5 g |
| negative working non-spectrally sensitized silver chloride emulsion containing silver chloride in an amount equivalent with 80 g of silver nitrate per sq.m. | 6 g |
| distilled water | 40 ml |
| HOSTAPON T (trade name) | 0.25 ml |

Coating composition (1*a*) was applied at a wet voerage of 63 g per sq.m providing a negative working silver chloride layer containing an amount of silver chloride corresponding with 0.5 g of silver nitrate per sq.m.

Coating composition (2*a*)

Coating composition (2*a*) forming a gelatin covering layer had the same composition as coating composition (2) and was applied to the dried coating (1*a*) in the same way as for material II.

Preparation of material IV according to the present invention

Material IV was prepared in the same way as material III with the difference, however, that between the negative working silver chloride emulsion layer and the gelatin covering layer a direct-positive silver halide emulsion layer as described for material II was applied but with a silver bromide coverage corresponding with 0.035 g of silver nitrate per sq.m.

Preparation of dye receptor material

To a corona-treated polyethylene coated paper support a coating having the following composition was applied per sq.m:

| | |
|---|---|
| gelatin | 5 g |
| triphenyl-n-hexadecylphosphonium bromide | 2 g |

Exposure and processing of the material I, II, III and IV

Material I which does not contain a photosensitive layer was not photoexposed imagewise but diffusion-transfer-processed as such in the COPYPROOF CP 38

(trade name) diffusion transfer processing apparatus containing in its tray an aqueous solution comprising per liter:

| | |
|---|---|
| sodium hydroxide | 10 g |
| sodium orthophosphate | 25 g |
| triisopropanolamine | 80 g |
| potassium bromide | 2 g |
| 1% ethanolic solution of 1-phenyl-2-tetrazoline-5-thione | 7 ml |
| 1-phenyl-4-methyl-3-pyrazolidinone | 1.5 g |
| paraformaldehyde | 4 g |

After being wetted at room temperature (20° C.) with said solution material I was contacted for 1 min with the above receptor material to allow the diffusion transfer of cyan dye. After separating material I from the receptor material cyan dye was found to be present on the receptor material in an amount corresponding with a red light density ($D_R$) 1.86 measured with a MACBETH (trade name) densitometer RD-100R behind a Kodak Wratten filter Red No. 25.

The above Wratten filter No. 25 manufactured by The Eastman Kodak Company has a percent transmittance as represented on page E-218 of the Handbook of Chemistry and Physics, 52nd Edition, Editor Robert C. Weast—CRC Press 18901 Cranwood Parkway, Cleveland, Ohio 44128, U.S.A.

Material II was partly not exposed, partly exposed with white light and partly with one third spectrum colour light in the wavelength range of 500 to 600 nm (green light).

The diffusion-transfer-processing of said material II and the measurement of the red light density ($D_R$) proceeded likewise as described for material I.

The areas of the receptor material corresponding with the non-exposed area and the white light or green light-exposed area of material II had a red light density of 0.48 and 1.56 respectively.

Material III was partly not exposed and exposed partly with white light and partly with green light as described for material II and the processing and measurement of the red light density ($D_R$) proceeded likewise as for the said material II.

The areas of the receptor material corresponding with the non-exposed area and the green light-exposed area of material III had a red light density ($D_R$) of 1.80. The areas corresponding with the white light exposed areas had a red light density ($D_R$) of 0.10.

Material IV was partly non-exposed and exposed partly with white light and partly with green light as described for material II and the processing and measurement of the red light density ($D_R$) proceeded likewise as for said material II.

The areas of the receptor material corresponding with the non-exposed area and the green light-exposed area of material IV had a red light density ($D_R$) of 1.25 and 1.72 respectively. In correspondence with the white light-exposed area a red light density ($D_R$) of 0.14 was measured.

From the above results it is apparent that whereas with material III, both the non-exposed area (corresponding with the black area of the original) and the green light-exposed area yield on diffusion transfer processing on the receptor material a red light density of 1.80, the non-exposed area of material IV with a direct positive and a negative emulsion layer yields a reduced red light density of 1.25 and the green light-exposed area of material IV yields a red light density of 1.72, i.e. higher than that of the non-exposed area, which proves that a positive interimage effect is obtained.

I claim:

1. A photographic material suitable for producing by diffusion transfer a positive colour image in a diffusion transfer receptor layer, said material comprising on a support at least two differently spectrally sensitive negative working silver halide emulsion layers and having operatively associated with each of said emulsion layers a different dye providing compound that is initially immobile in an alkali-permeable colloid medium and from which by reduction in an alkaline medium a dye or dye precursor can be split off in diffusible state, characterized in that at least one of said negative working silver halide emulsion layers is associated in water-permeable relationship with a visible light-sensitive direct-positive working silver halide emulsion layer.

2. Photographic material according to claim 1 comprising a support carrying three said differently spectrally sensitive negative working silver halide emulsion layers, viz. a red-sensitive, green-sensitive and blue-sensitive layer, characterized in that between the blue-sensitive silver halide emulsion layer and the green-sensitive silver halide emulsion layer and between the green-sensitive silver halide emulsion layer and the red-sensitive silver halide emulsion layer, a visible light-sensitive direct-positive working silver halide emulsion layer is present in water-permeable relationship with said emulsion layers.

3. Photographic material according to claim 2, wherein the direct-positive silver halide emulsion layers are sensitive to light of the whole visible light spectrum.

4. Photographic material according to claim 1, characterized in that the dye providing compound is a ballasted compound capable of undergoing an electron-accepting nucleophilic displacement reaction separating thereby in alkaline medium a diffusible dye or dye precursor moiety.

5. Photographic material according to claim 1, characterized in that the dye providing compound is a ballasted compound capable of being split by reduction under alkaline conditions into a ballasted quinone methide compound and a diffusible dye or dye precursor moiety.

6. Photographic material according to claim 1, characterized in that said material contains a mixture of reducing agents consisting of at least one electron donor and at least one electron-transfer agent the latter being a better silver halide reducing agent under alkaline conditions than the electron donor and wherein the electron transfer agent functions to develop the exposed silver halide of the negative working silver halide emulsion layer(s) and to develop unexposed silver halide of the direct-positive silver halide emulsion layer(s) and provides a corresponding image-wise pattern of oxidized electron donor compound which compound in unoxidized form is capable of reducing said dye-providing compound(s).

7. Photographic material according to claim 6, characterized in that said electron transfer agent is present therein as developing agent in diffusible state.

8. Photographic material according to claim 6, characterized in that said electron donor is used in non-diffusible state in each negative working silver halide emulsion layer containing said different dye-providing compound.

9. Photographic material according to claim 6, characterized in that the electron donor is used in said material in a molar range of 1:2 to 4:1 with respect to the dye providing compound and the electron transfer agent is applied in the same molar range.

10. Photographic material according to claim 1, characterized in that the direct-positive working silver halide emulsion layer(s) is (are) coated from a silver halide emulsion wherein by exposure or by chemical treatment a developable fog has been produced, which fog is image-wise destroyable by image-wise photo-exposure.

* * * * *